United States Patent [19]

Rylander

[11] Patent Number: 4,749,011

[45] Date of Patent: Jun. 7, 1988

[54] FLEXIBLE BAG HOLDER

[76] Inventor: Nicholas M. Rylander, 4501 E. 45 St., Tulsa, Okla. 74135

[21] Appl. No.: 946,612

[22] Filed: Dec. 24, 1986

Related U.S. Application Data

[63] Continuation of Ser. No. 745,262, Jun. 14, 1985, abandoned, which is a continuation-in-part of Ser. No. 541,887, Oct. 14, 1983, abandoned.

[51] Int. Cl.[4] ..... B65B 39/02; B65B 67/00

[52] U.S. Cl. ..... 141/316; 141/114; 141/98; 141/390; 248/99; 220/402; 53/390

[58] Field of Search ..... 53/384, 390; 493/480; 220/402; 248/97, 99, 100; 383/33, 34, 104, 119; 141/10, 108, 114, 337, 313–316, 390–392, 98

[56] References Cited

U.S. PATENT DOCUMENTS

| | | | |
|---|---|---|---|
| 571,513 | 11/1896 | Davidson | 141/390 X |
| 791,472 | 6/1905 | Kaiser | 141/108 |
| 1,167,782 | 1/1916 | Richards | 141/314 |
| 1,211,278 | 1/1917 | Blum | 141/316 |
| 1,879,410 | 9/1932 | Morris et al. | 493/480 |
| 2,636,656 | 4/1953 | Tanabe | 141/314 |
| 3,722,561 | 3/1973 | O'Leary et al. | 141/316 |
| 3,734,340 | 5/1973 | Ippolito et al. | 220/402 |
| 3,822,524 | 7/1974 | Jerpbak | 141/390 X |
| 3,915,329 | 10/1975 | Zaks | 141/316 X |
| 3,936,087 | 2/1976 | Alexander | 248/99 X |
| 3,937,354 | 2/1976 | Clar | 220/402 |
| 3,983,914 | 10/1976 | Benson | 141/390 |
| 4,014,157 | 3/1977 | Pearce | 141/390 |
| 4,037,778 | 7/1977 | Boyle | 53/390 X |
| 4,312,531 | 1/1982 | Cross | 248/99 X |
| 4,457,483 | 7/1984 | Gagné | 248/97 |
| 4,628,007 | 12/1986 | Ledsham | 141/390 |

FOREIGN PATENT DOCUMENTS

| | | | |
|---|---|---|---|
| 0186978 | 7/1986 | European Pat. Off. | 53/390 |

*Primary Examiner*—Henry J. Recla
*Assistant Examiner*—Ernest G. Cusick
*Attorney, Agent, or Firm*—Head & Johnson

[57] ABSTRACT

A device for use with a flexible bag in order to hold the bag open for facilitating access to the interior thereof, and comprising a body having a normal substantially flat planar configuration and sufficiently flexible for responding to pressure thereagainst for deforming into a substantially cylindrical configuration, one cylindrical configuration thereof being of a diametric size smaller than the diametric size of the bag for facilitating insertion of the body into the interior of the bag, and the body having sufficient memory characteristics for springing radially outwardly from the one cylindrical configuration for restriction by the sidewall of the bag whereby the bag is retained in a fully open position, the body being responsive to the release of pressure thereagainst for returning to the normal flat planar configuration thereof.

2 Claims, 5 Drawing Sheets

FLEXIBLE BAG HOLDER

CROSS-REFERENCE TO RELATED APPLICATIONS

This is a continuation of application Ser. No. 745,262 filed on June 14, 1985, now abandoned, which is a continuation-in-part of U.S. patent application Ser. No. 541,887 filed Oct. 14, 1983 entitled "Device for Facilitating The Use of Flexible Plastic", now abandoned.

BACKGROUND OF THE INVENTION

1. Field of the Invention

This invention relates to improvements in containers and more particularly, but not by way of limitation, to means for facilitating the filling and use of flexible plastic trash bags, and the like.

2. Description of the Prior Art

The burning of waste products, such as trash, grass clippings, leaves, debris, and the like is banned in many areas of the United States at the present time, because of rules and regulations relating to the control of the environment. As a result, the use of flexible plastic bags, commonly called trash bags, leaf bags, lawn bags, or the like, has become widespread for initial sorting of the wast products and transporting thereof to a proper and approved dump site. These bags are normally constructed from plastic sheeting material, and are comprised of two substantially flat sheets having three edges closed, and the fourth edge open to provide access to the interior of the bag. The two sheets have a normal intimately disposed or surface to surface engagement in the non-use or original condition of the bag, and in order to gain access to the interior of the bag it is necessary to separate the two sheets. The extremely flexible nature of the two sheets renders the separation thereof, and particularly the maintaining of the separation therebetween quite difficult, and thus the bags become unhandy to use in the initial stages of the filling thereof. Even when the bags have been partially filled, and the interior thereof is more accessible, the bags tend to topple over due to the relatively flimsy nature of the plastic sheeting material.

SUMMARY OF THE INVENTION

The present invention contemplates a novel device for use in combination with the usual flexible plastic sheeting type trash bag, or the like, and is particualrly designed and constructed for overcoming the foregoing disadvantages. The novel device comprises a sheet or plate of an initial substantially flat configuration and constructed of a suitable material having the chemical and physical properties wherein the sheet may be readily manually deformed to a subtantially cylindrical or arcuate configuration of substantially any desired diameter or radius and which will return to its normal flat configuration upon the complete release of external pressures thereon. This results in a "spring-type" action for the device in use in combination with the trash bag. In order to facilitate the opening of the trash bag, or the separation of the close-lying front and back sheets of the bag, the device may be manually formed into a substantially cylindrical configuration by applying pressure against one face thereof. The open end of the trash bag may be manually positioned over one end of the cylindrically formed device and pulled longitudinally upwardly thereover until the said end of the device engages the closed bottom of the bag. The manual pressure against the device may then be released, and the "spring-like" action of the device causes the device to attempt to return to its normal or initial flat configuration. The action is restrained by the walls of the trash bag, and thus the device holds the bag in an open position throughtout the entire length of the bag. This not only facilitates maintaining the bag in a substantially upright position during filling thereof, but also facilitates the depositing of debris, or the like, through the open end of the bag. In addition, the outer end of the device normally protrudes beyond the outer limit of the open end of the trash bag, and may be utilized as a "scoop" for the bag for facilitating the movement of leaves, grass clippings, and the like, into the interior of the bag. In this type operation, the bag may be positioned in substantially horizontal position on the surface of the ground, or the like, and debris may be swept into the interior thereof through the open end, with the protruding portion of the device facilitating the entry of the debris into the bag. When the bag has been filled, the device may be readily removed from engagement therewith by the application of sufficient longitudinal pressure, and upon the removal of the device from the bag, the bag may be closed in any well known manner, such as by use of a suitable tie, or the like. The device, having been removed from the bag, resumes or returns to its normal flat position or configuration for facilitating storage thereof until such time as it is to be reused. The novel device is simple and efficient in operation and economical and durable in construction.

In a preferred embodiment, when the device of my invention is lying flat like a plate, there is an extending flange in the center of one side which extends equally on each side of a center line therethrough and extends about one-half of the width of the plate leaving two shoulder members. There is a hand slot cut through the material below each such shoulder in the main part of the plate. In operation, the sheet is folded into a more or less cylindrical or frusto-conical configuration and the hand slots are used to place the hand through both slots and hold the configuration in the desired shape while it is placed into the plastic trash bag. Once in, the hands release the slots and the plastic sheet or plate expands to hold the plastic trash bag in the desired opened upright position.

DETAILED DESCRIPTION OF THE PREFERRED EMBODIMENT

Figure 1:
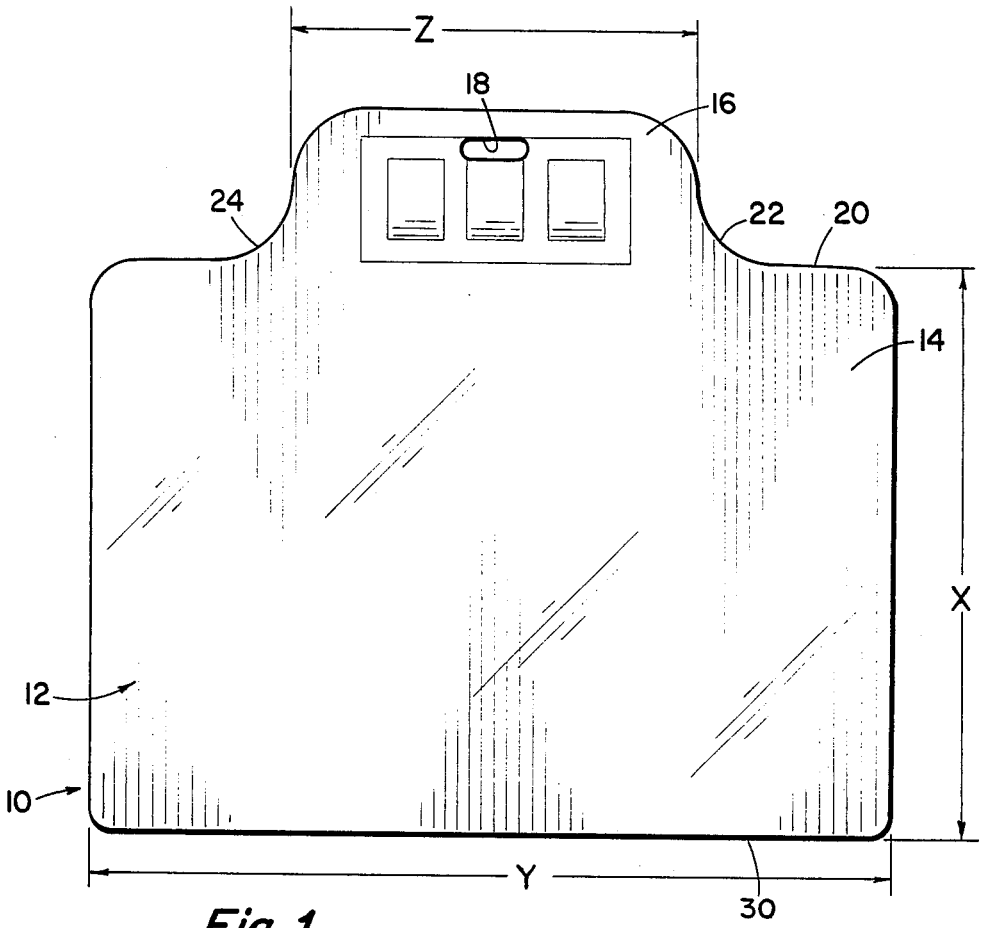
FIG. 1 is a plan view of a trash bag facilitator device embodying the invention.
Figure 4:
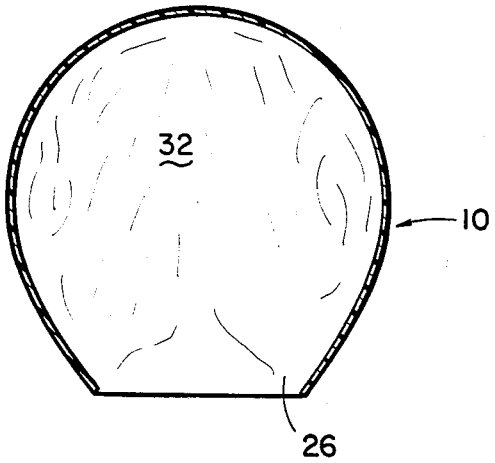
FIG. 4 is a view taken on line 4—4 of FIG. 3.

Referring to the drawings in detail, reference character 10 generally indicates a trash bag facilitator device comprising a substantially flat body portion 12 constructed from a suitable material having sufficient flexibility for rolling or forming thereof into a substantially cylindrical configuration, elastically for returning to the normal or initial flat configuration thereof subsequent to being formed into the cylindrical configuration, a sufficient memory characteristic for resisting taking a "set" in the rolled configuration thereof, and sufficiently tough and weather resistant for resisting damage from sharp objects during use thereof and damage thereto from ambient weather conditions. One such material which might be used is a polycarbonate material having a thickness of 0.060, this material being a tough, transparent plastic sheet material.

Whereas the outer periphery of the body 12 may be substantially as desired, it is preferable that the body 12 comprise a substantially rectangular main portion 14 having a centrally disposed outwardly extending flange member 16 provided along one edge thereof, the flange member 16 being coplanar with respect to the main portion 14. It may also be preferable to provide an elongated slot means 18 in the flange means 16 to provide a hand-hold for facilitating the use of the device 10, as will be hereinafter set forth.

In the event the flange 16 is provided along one edge of the main body portion 14, such as the edge 20, it is preferable that the juncture between the opposite ends of the flange 16 and the said edge 20 be of an arcuate configuration as shown at 22 and 24 in FIG. 1. In addition, it is also preferable that all of the corners of the main body portion 14 be arcuate in order to reduce damage to a plastic trash or leaf bag with which the device 10 is to be utilized.

Figure 2:
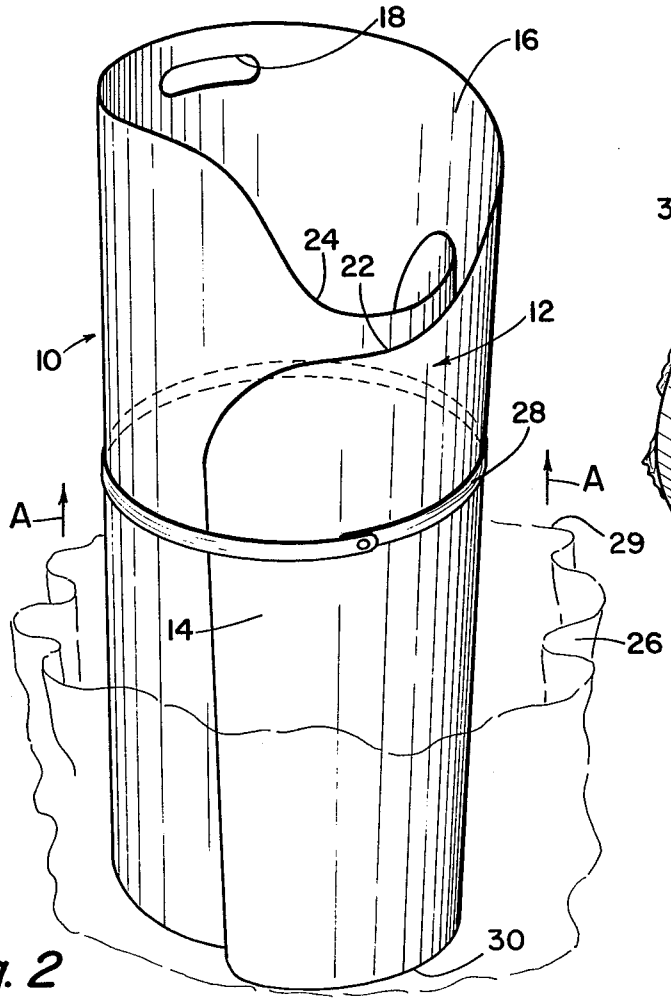
FIG. 2 is a perspective view illustrating an initial position of use for the device embodying the invention as used in combination with a trash bag.

In use, the body 12 may be manually formed into a substantially cylindrical configuration by applying sufficient pressure against one side of the body 12 whereby the device 10 may assume a configuration as generally shown in FIG. 2. If desired, a suitable belt or strap means 28 may be removably secured around the outer periphery of the device 10 to maintain the body 12 in the cylindrical configuration thereof. The bag 26 may be manually pulled longitudinally upwardly over the cylindrically arranged device in the direction of the arrows A by placing the open end 29 of the bag 26 over the outer periphery of body 12, as particularly shown in broken lines in FIG. 2. It is preferable that the bag 26 be pulled over the outer periphery of the cylindrically arranged device 10 until one end 30 (FIG. 5) of the device 10 engages the bottom 32 of the bag 26. The strap means 28 may then be released or removed from engagement with the outer periphery of the body 12, whereupon the spring-like action of the body 12 will cause the body 12 to attempt to return to its normal substantially flat or planar configuration. The sidewalls of the bag 26 will restrict the outward movement of the body 12 in the direction toward its planar configuration, whereupon the body 12 will hold the bag 26 in a fully open position from the open end thereof to the bottom 32 thereof, as particularly shown in FIGS. 3 and 5. This provides an efficient access to the interior of the bag 26 for filling thereof with debris, trash, lawn clippings, leaves, and the like, as desired.

Figure 5:
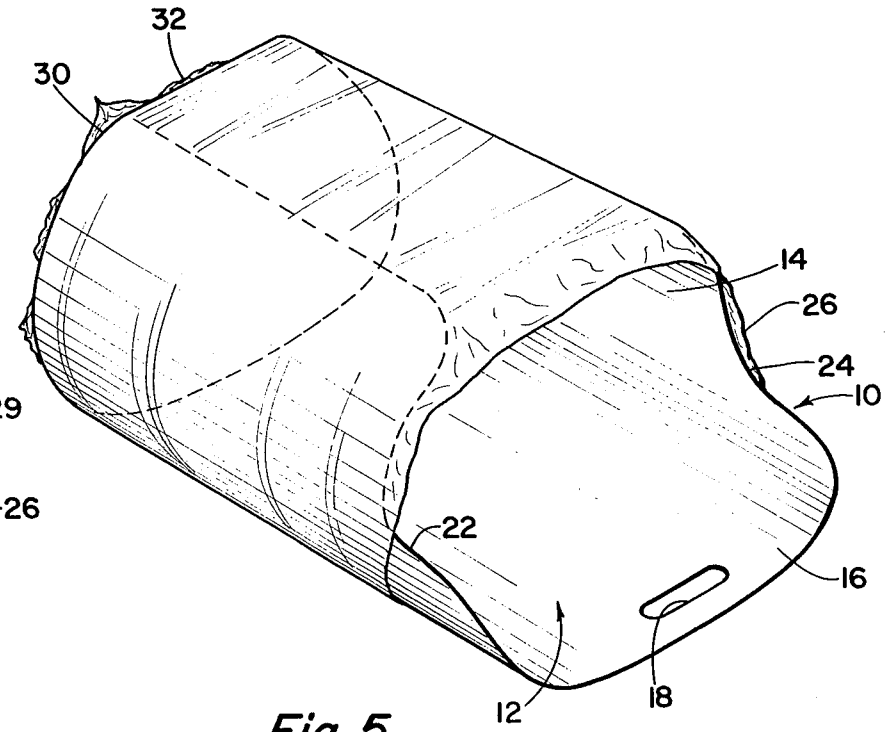
FIG. 5 is a perspective view of a device embodying the invention in combination with a trash bag and illustrating a use of the combination in a substantially horizontal disposition.
Figure 3:
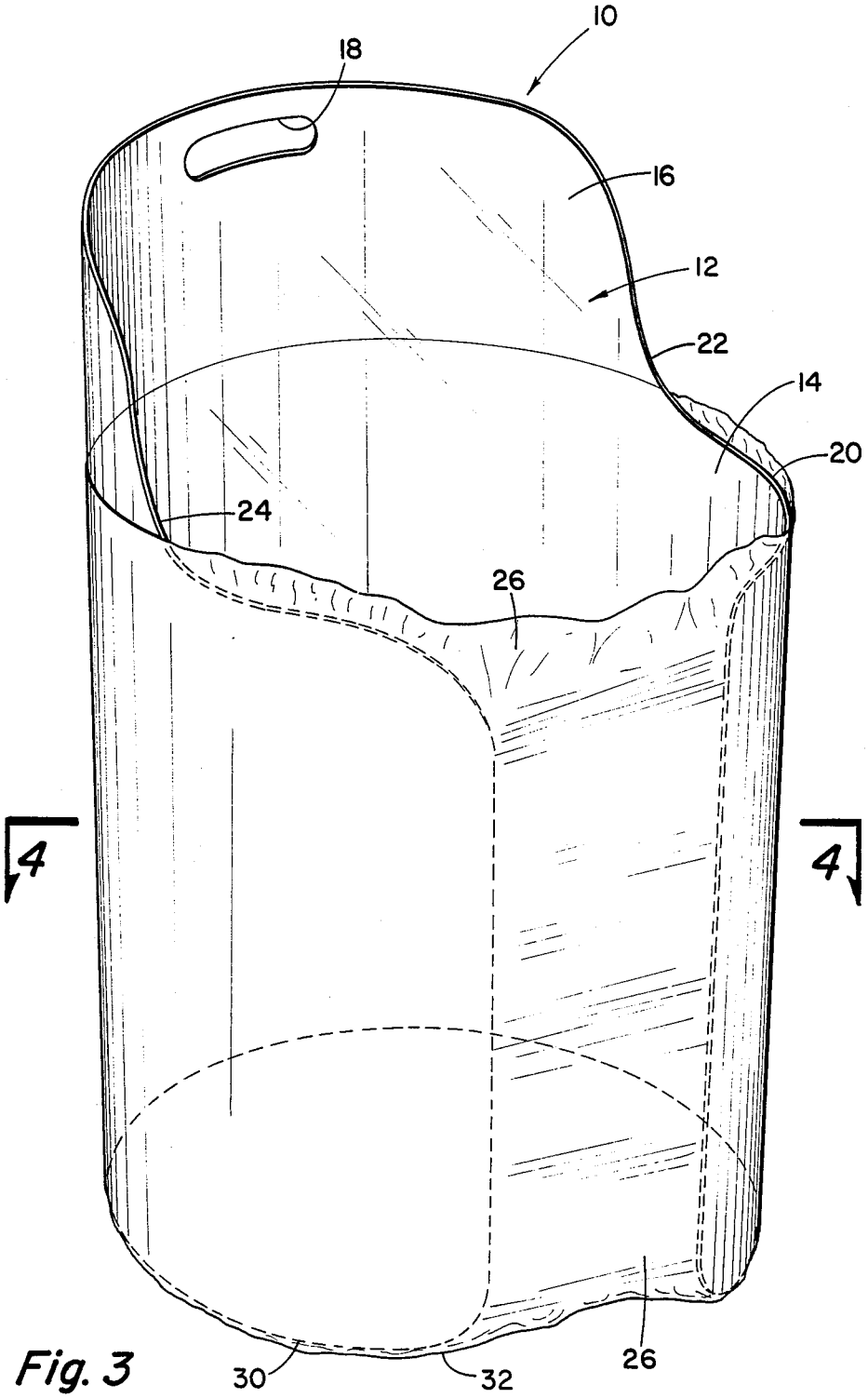
FIG. 3 is a perspective view of a device embodying the invention and illustrated in a final position for facilitating the use of a trash bag.

The rigidity of the device 10 will facilitate the supporting of the bag 26 in an upright position, as shown in FIG. 3, thus providing for ease of loading of the bag 26. In some instances, however, it may be desirable or efficient to position the bag 26 and device 10 disposed therein in a substantially horizontal position on the surface of the ground, or the like, as shown in FIG. 5. In this position, the flange 16 which normally protrudes beyond the open end of the bag 26 performs in much the same manner as a scoop or "dust pan" whereby leaves or other debris may be swept from the surface of the ground and through the open end of the bag for being deposited in the interior of the bag. Upon sufficient filling of the bag 26, the flange 16 and particularly the hand hold aperture 18 thereof may be manually grasped for moving the bag and device 10 to the upright position therefor, if desired.

Figure 6:
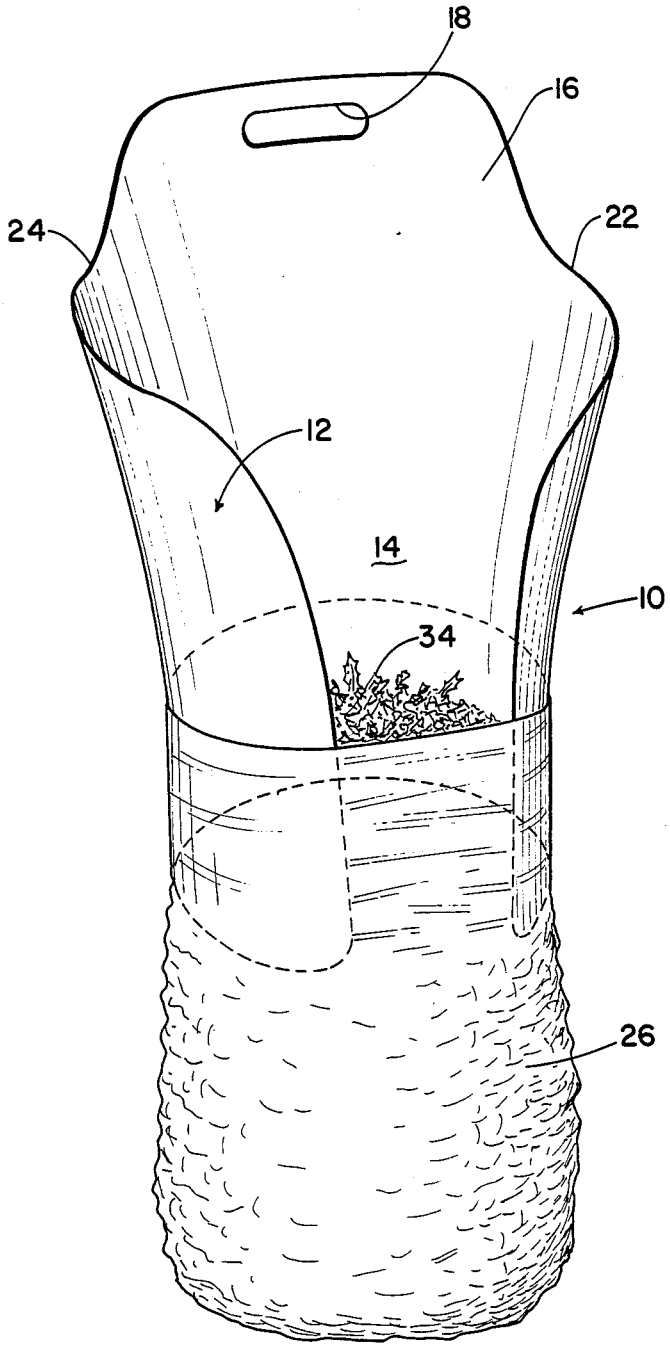
FIG. 6 is a perspective view of the device embodying the invention in combination with a trash bag and illustrating the removal of the device from engagement with the bag.

When the desired quantity of contents 34 have been deposited within the bag 26, the device 10 may be readily removed from the position within the bag by manually grasping the portion of the device 10 protruding from the bag and pulling the device longitudinally away from the bag 26, as particularly shown in FIG. 6. When the device 12 is completely removed from its engagement with the bag 26, the body 12 returns to its normal substantially flat position, and the bag may be closed in the usual manner, such as by tying the open end with a bag tie as is well known.

It is to be noted that the flat disposition of the body 12 facilitates the storing of the device 10 since many of the devices may be stacked on top of one another for storage in a relatively small floor area. In addition, the flexible nature of the material from which the body 12 is constructed lends the device to ease of rolling thereof into a substantially cylindrical configuration, which also facilitates the storing of the device since several of the devices may be rolled together and stored within one another.

Whereas, the overall dimensions of the device 10 may be selected as desired in accordance with the bag 26 with which it is to be utilized, it is preferable that one dimension X of the main body portion 14 be of a length slightly less than the overall length of the bag 26, and the dimension Y thereof as shown in FIG. 1 be of a sufficient length as to surround the greater portion of the circumference of the bag 26 in the released position thereof when disposed within the bag. It is also preferable that the dimension Z of the flange 16 be approximately one-half the length of dimension Y to provide a sufficient size for the flange to permit efficient use as a scoop in the horizontally disposed orientation of the bag 26 as shown in FIG. 5.

From the foregoing it will be apparent that the present invention provides a novel means for facilitating the use of the well known and widely used plastic bag commonly known a a trash or leaf bag. The device comprises a substantially flat body of sufficient flexibility to be rolled into a cylindrical configuration small enough for insertion into the iterior of the bag and having a spring-like quality whereupon the cylindrical configuration of the body will be expanded against the sidewalls of the bag for holding the bag in an open and accessible position for receiving articles therein. The device may be readily removed from engagement with the gab upon the filling of the bag, whereupon the bag may be closed in the usual manner, and the device may be stored for future use.

Figure 8:
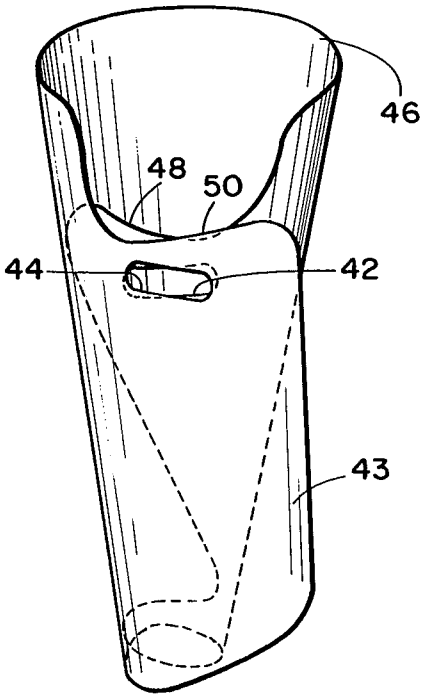
FIG. 8 is a perspective view illustrating an initial position of use for the device embodying the invention shown in FIG. 7 as used in combination with a trash bag.
Figure 7:
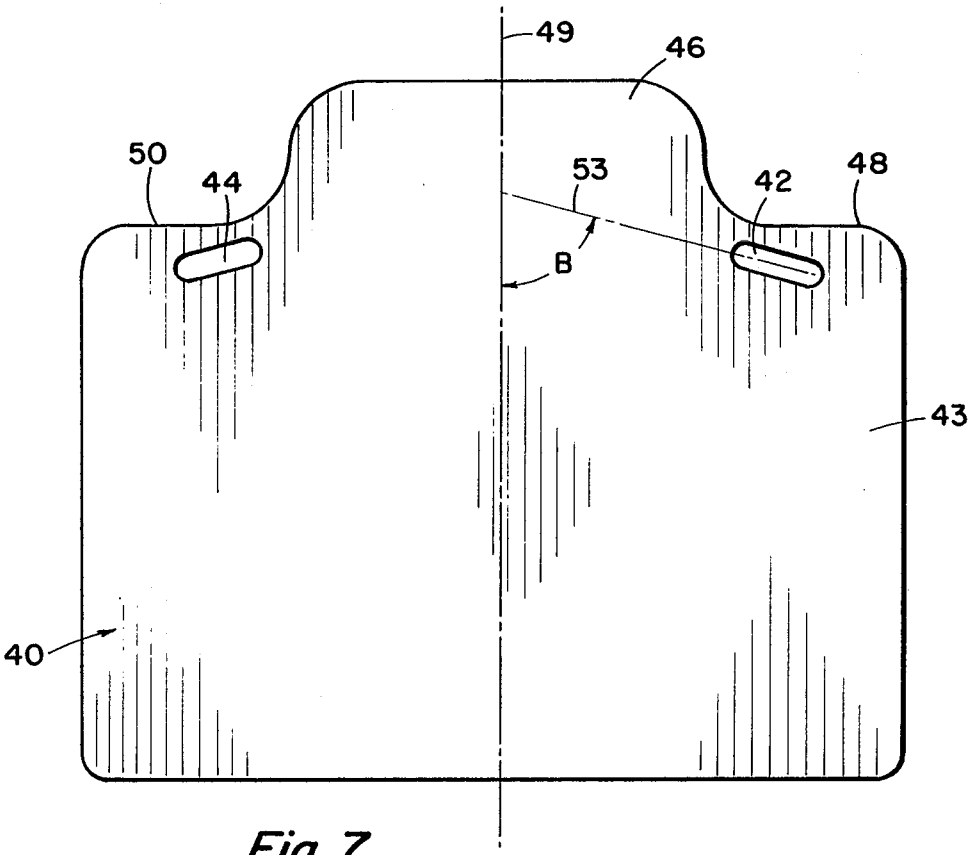
FIG. 7 is a plan view of a trash bag facilitator device embodying another embodiment of my invention.

Attention is next directed to FIGS. 7 and 8 which show another embodiment of my invention. Shown thereon is a trash bag facilitator device comprising a substantially flat body portion 40 which is similar to that described above for reference numeral 12 in FIG. 1.

Whereas the outer periphery of the body 40 may be substantially as desired, it is preferable that the body 40 comprise a sustantially rectangular main portion 43 having a centrally disposed outwardly extending flange member 46 provided along one edge thereof, the flange member 46 being co-planar with respect to the main portion 40. The trash bag facilitator device is preferably symmetrical about axis 49. The outer periphery of the flat body portion 40 is substantially the same as that described above in regard to flat body 12. Extending flange member 46 curves smoothly into shoulders 48 and 50.

There are provided hand slots 42 and 44 in main body 43 just below shoulders 48 and 50 respectively. It is preferred that these hand slots 42 be slopping upwardly toward center line 49 which would be a non-perpendicular angle or other than 90°. It is especially preferred that the center line 53 through slot 42 make an angle B with the line 49 up between about 70 and 80 degrees. An especially preferred angle is 75 degrees.

When it is desired to use the trash bag facilitator device shown in FIG. 7, the device is rolled up similar to that shown in FIG. 8 with the fingers of one hand extending through slots 42 and 44. This tends to align the slots 42 and 44 and in doing so, it makes the lower end of the flat body portion 40 smaller than the upper end and takes the shape more or less of an ice cream cone. This facilitates the insertion of the trash bag facilitator device into a plastic trash bag. Once the facilitator device is inserted in the bag, the hand is removed from the slots 42 and 44 thus permitting the flat body portion 40 to expand outwardly into nearly a cylindrical shape.

Whereas the present invention has been described in particular relation to the drawings attached hereto, it should be understood that other and further modifications, apart from those shown or suggested herein may be made within the spirit and scope of this invention.

What is claimed:

1. In combination with a flexible bag having an open end, means for facilitating the use of the bag and comprising a unitary body means having a main body portion of a normal, substantially flat planar generally rectangular configuration having one dimension Y and having one face and a second face and constructed from a material sufficiently flexible for responding to pressure against one face thereof for deforming into a substantially cylindrical configuration, one cylindrical configurational mode of the body means being of diametric size smaller than the diametric size of the bag for facilitating removal and insertion of the body means through the open end of the bag and into the interior thereof and the construction material of the body means having sufficient memory characteristics for springing radially outwardly from said one cylindrical configuration mode to a slightly larger diametric cylindrical mode for restriction by engagement with the inside of the bag whereby the bag is retained in a fully open position by the engagement of the body means therewith for facilitating access to the interior thereof, the body means being responsive to longitudinal force applied thereto for removal thereof from the interior of the bag, the normal flat planar configuration of the body means being restored upon removal thereof from engagement with the bag, said body means comprising a main body portion of a substantially rectangular configuration having four edges integral with said body portion and planar flange extending outwardly along one edge of the main body portion for a distance Z which is not over about one-half the dimension Y and being coplanar with respect thereto.

2. In combination with a flexible bag, means as set forth in claim 1 wherein the flange means is provided with slot means providing a hand hold for facilitating manipulation of the body means.

* * * * *